US009934683B2

(12) United States Patent
Fowe

(10) Patent No.: US 9,934,683 B2
(45) Date of Patent: Apr. 3, 2018

(54) TRAFFIC AGGREGATION AND REPORTING IN REAL-TIME

(71) Applicant: HERE Global B.V., Eindhoven (NL)

(72) Inventor: James Adeyemi Fowe, Evanston, IL (US)

(73) Assignee: HERE Global B.V., Eindhoven (NL)

( * ) Notice: Subject to any disclaimer, the term of this patent is extended or adjusted under 35 U.S.C. 154(b) by 146 days.

(21) Appl. No.: 14/289,988

(22) Filed: May 29, 2014

(65) Prior Publication Data

US 2015/0348406 A1 Dec. 3, 2015

(51) Int. Cl.
*G08G 1/00* (2006.01)
*G08G 1/0967* (2006.01)

(52) U.S. Cl.
CPC . *G08G 1/096716* (2013.01); *G08G 1/096741* (2013.01); *G08G 1/096775* (2013.01)

(58) Field of Classification Search
CPC ..... G01C 21/3492; G01C 21/3453; G01C 21/3446; H04H 20/55
See application file for complete search history.

(56) References Cited

U.S. PATENT DOCUMENTS 7,908,075 B2 3/2011 Qi et al.
7,908,076 B2 * 3/2011 Downs ..... G08G 1/0104 701/117
8,463,543 B2 * 6/2013 Waldman ..... G01C 21/3644 701/410
8,700,294 B2 4/2014 Downs et al.
8,849,552 B2 * 9/2014 Schunder ..... G01C 21/32 701/117
9,219,500 B2 * 12/2015 Schilling ..... H03M 7/40
9,224,221 B2 * 12/2015 Vogel ..... G09G 5/02
2004/0073361 A1 * 4/2004 Tzamaloukas ..... G01C 21/3691 701/414
2008/0071466 A1 * 3/2008 Downs ..... G08G 1/0104 701/117
2011/0004513 A1 * 1/2011 Hoffberg ..... G06Q 30/0207 705/14.1
2011/0196610 A1 * 8/2011 Waldman ..... G01C 21/3644 701/533
2011/0224898 A1 9/2011 Scofield et al.
2012/0158301 A1 * 6/2012 Schilling ..... H03M 7/40 701/533
2013/0147828 A1 * 6/2013 Vogel ..... G09G 5/02 345/589
2015/0170514 A1 * 6/2015 Stenneth ..... G08G 1/0129 701/117

FOREIGN PATENT DOCUMENTS

WO WO2008021551 A2 2/2008
WO WO2011113021 A1 9/2011
WO WO2011113022 A1 9/2011

* cited by examiner

*Primary Examiner* — Jerrah Edwards
(74) *Attorney, Agent, or Firm* — Alston & Bird LLP

(57) ABSTRACT

Systems, apparatuses, and methods are provided for aggregating and reporting real-time traffic conditions. Real-time traffic data for a network is collected. A request from a customer is received for a percentage of the real-time traffic data in the network, the percentage being greater than 0% and less than 100%. The real-time traffic data in the network is aggregated. The aggregated real-time traffic data is reported to the customer.

21 Claims, 6 Drawing Sheets

TRAFFIC AGGREGATION AND REPORTING IN REAL-TIME

FIELD

The following disclosure relates to systems, apparatuses, and methods for real-time traffic processing and reporting, or more particularly, to systems, apparatuses, and methods for aggregating real-time traffic data and reporting critical road segment data within a city or metropolitan area.

BACKGROUND

Traffic aggregation has been performed at link level, at traffic messaging channel (TMC) level, or at the level of a linear strand (e.g., a stretch of links in a straight road segment). Links on a map or a transportation network may be published with speed or travel-time in real-time. Traffic application users or consumers may be required to pull traffic information for all links and then use the links in their region of interest.

While some consumers may use most of the published traffic information for their specific application use cases, others consumers may only use only a fraction of the published traffic information. Therefore, providing real-time, accurate traffic information, based on the type of need or level of detail required by the consumer, is a continuing effort.

SUMMARY

Systems, apparatuses, and methods are provided for aggregating and reporting real-time traffic conditions. In one embodiment, the method comprises collecting real-time traffic data for a network. The method further comprises receiving a request from a customer for a percentage of the real-time traffic data in the network, the percentage being greater than 0% and less than 100%. The method further comprises aggregating, using a processor, the real-time traffic data in the network. The method further comprises reporting the aggregated real-time traffic data to the customer.

Apparatuses are also provided for determining real-time traffic conditions. In one embodiment, the apparatus comprises at least one processor and at least one memory including computer program code for one or more programs, wherein the at least one memory and the computer program code configured to, with the at least one processor, cause the apparatus to at least perform: (1) collect real-time traffic data for a network; (2) receive a request from a customer for a percentage of the real-time traffic data in the network, the percentage being greater than 0% and less than 100%; (3) aggregate, using a processor, the real-time traffic data in the network; and (4) report the aggregated real-time traffic data to the customer.

BRIEF DESCRIPTION OF THE DRAWINGS

Exemplary embodiments are described herein with reference to the following drawings.

DETAILED DESCRIPTION

Figure 1A:
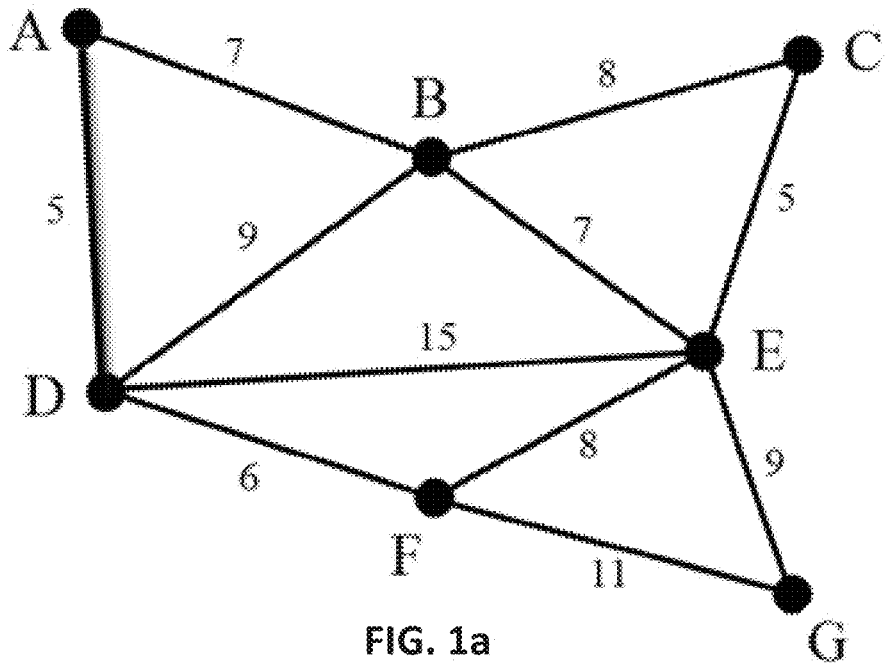
FIGS. 1*a* and 1*b* illustrate an example of a road network and a corresponding minimum spanning tree.

The following embodiments include systems, apparatuses, and methods for aggregating real-time traffic data and reporting critical road segment data within a city or metropolitan area.

In certain embodiments, real-time traffic data is reported to a customer based on the type of need or level of detail required by the customer. In other words, the customer may be able to define or request a specific amount of the aggregated traffic data and retrieve only the amount of data the customer needs in real-time. This may reduce the amount of overall data transferred to the customer, thereby potentially alleviating bandwidth usage, customer-side computational load, or mobile data capacity issues. Further, providing a calculated, requested fraction of the aggregated data may provide more value to the customer in comparison to the overall aggregated traffic data within the city or metropolitan area.

The traffic aggregation and real-time reporting embodiments described herein have a wide variety of potential commercial uses. In certain embodiments, the embodiments may be used in one or more of the following applications: (1) resource and cost allocation to regions of interest, (2) transportation planning or transportation demand management, (3) visualization of real-time traffic using minimal bandwidth and hardware resources, (4) traffic monitoring and control, (5) traffic publishing and control of load/bandwidth usage, (6) historical pattern of city-wide or metropolitan-wide transport network usage, (7) dynamic retail, (8) logistics, (9) real-time navigation, (10) traffic reporting (e.g., on television or radio), or (11) traffic report summarization for written news.

Aggregation of Traffic Data

A traffic provider may collect real-time traffic for an entire network, area, or region (e.g., a city or metropolitan area). Historical traffic data may also be collected and stored in a database by the traffic provider for the same city or metropolitan area. The real-time and historical traffic data may be collected using various techniques, such as those disclosed in U.S. application Ser. No. 14/105,501, herein incorporated by reference in its entirety. For example, the real-time and historical traffic data may include probe data such as the frequency of vehicles (i.e., the number of vehicles traveling in a road segment in a defined time frame), the average speed of the vehicles in the road segment in the defined time frame, and the average heading direction of the vehicles in the road segment in the defined time frame.

In certain embodiments, at least one customer may request that the traffic provider report only a percentage of the entire city's traffic data. Therefore, the traffic provider may calculate or prioritize which traffic data to report to the customer(s) or end-user(s). In other words, the traffic provider may determine varying percentages or levels of aggregated real-time traffic data from the entire city. For example, in one embodiment, there may be six levels of aggregation granularity represented as the level of aggregation (Ag(X)) in a range of X=0 to 5, wherein Ag(0) represents reporting all links and road segments in the network with no aggregation or summarization (e.g., prioritization). Ag(1) represents report large summary of the entire network (e.g., 40% of the links/road segments in Ag(0)), Ag(2) represents a smaller summary of the network (e.g., 20% of Ag(0)), Ag(3) represents an even smaller summary (e.g., 10% of Ag(0)), Ag(4) represents an even smaller summary (e.g., 5% of Ag(0)), and Ag(5) represents the smallest summary of the network (e.g., 1% of Ag(0)).

In other embodiments, more or fewer aggregation levels may be implemented. Additionally, the level of aggregations may be designed to represent higher or lower percentages of the overall network. For example, in an alternative embodiment, the real-time traffic data may be segmented into five levels of aggregation, wherein Ag(0)=100% of the links/road segments in the network/area/city, Ag(1)=50% of the links/road segments, Ag(2)=25% of the links/road segments, Ag(3)=12.5% of the links/road segments, Ag(4)=6.25% of the links/road segments.

In certain embodiments, the determined amount or defined aggregation amount of the real-time traffic data for the network/area/city may be reported to a customer. In certain embodiments, the customer may request or select the specific aggregation level reported. The customer's decision on which level of reporting may be based upon a variety of factors, including but not limited to, the cost of the reported traffic data, the bandwidth constraints for the reported real-time traffic data, or the lack of value in the excluded real-time traffic data. For example, a customer may decide to purchase reporting data for only 1% of the overall traffic data for the network/area/city based on the customer's bandwidth constraints in receiving additional real-time traffic data reporting for the remainder of the city, as well as the lack of value in the remaining 99% of the traffic data.

In certain embodiments, an algorithm is used to determine and prioritize (or rank) what real-time traffic information may be reported to the customer. The algorithm may elicit the most important road traffic segments' (in real-time) based on the road segments' historical and current traffic states. For example, the importance or value assigned to a specific piece of traffic information (e.g., a specific road segment) may be based on the traffic condition containing a "surprise" (big or small). A surprise may be that an incident has occurred within the road segment, that the road segment is blocked, or that a usually congested road segment at a particular time of the day is surprisingly free. Hence, the importance or value of the traffic condition for the road segment may be letting the customer know about the surprise conditions in real-time.

In other embodiments, the algorithm may calculate and prioritize real-time traffic information based on the customer's current location or the customer's predefined area of interest. For example, if a critical traffic event (e.g., a traffic accident) occurs on a typically uncongested road-segment in a corner of the city, the report of the real-time traffic conditions on the road segment may not qualify as a "surprise" for most customers. Nonetheless, the accident would qualify as a "surprise" worthy of reporting for a customer (and the customer's navigation system) who lives near the location of the accident.

Prioritizing or ranking real-time traffic information may comprise calculating a cost function (CF(t)) for particular road segments based on a number of different factors. The factors may include one or more of the following: traffic density (K), real-time average speed (Vr), historical average speed (Vh), free flow speed (FF), and surprise (S).

Traffic density (K) may refer to the number of cars occupying a road segment within a given time. Traffic density may be derived from historical data that has measured the number of cars that transverse a road segment within a defined time period. In certain examples, a transportation network has a higher traffic density at peak traffic periods (e.g., during commuting times on non-holiday weekday mornings and evenings).

Real-time average speed (Vr) may refer to how fast vehicles are traveling across a specified road segment in real-time. This measurement may assist in identifying congestion, free moving traffic, or surprise traffic conditions.

Historical average speed (Vh) may refer to the average speed for vehicles traveling across a specified road segment at a specified time. The historical average speed may be different at peak traffic periods (e.g., rush hour) versus off-peak traffic periods (e.g., weekends, holidays). This measurement may assist in identifying higher capacity roads (i.e., road segments with higher historical average speeds are typically higher capacity roads that are critical to the network/area/city). Additionally, historical average speed may be helpful in determining free flow speed.

Free flow speed (FF) may refer to how fast vehicles may travel on a road segment. The measurement is directly proportional to the capacity/size of the road segment (i.e., a measure of traffic density). Free flow speed may assist in determining the level of congestion in real-time based on a comparison between the maximum free flow speed and the real-time average speed.

Surprise (S) may refer to the difference between the real-time average speed and the historical average speed (i.e., S=|Vr−Vh|) for a particular road segment of interest. Reporting surprises on important road-segments in a transportation network in real-time may provide more value over reporting traffic speeds for all links/road segments, because, in a majority of circumstances, drivers/consumers already know what the expected traffic will be on most of the roads at a given time of the day.

Naïve Aggregation Algorithms

In certain embodiments, the algorithm used to calculate and prioritize the real-time traffic information is a naïve algorithm that creates a priority queue by ranking the various road segments within a network using a cost function. In one embodiment, the cost function is:

$$CF(t)=K(t)*(|Vr(t)-Vh(t)|) \tag{1}$$

wherein the road segments are ranked based on a function of the traffic density of the road segment multiplied by the difference of the real-time average speed and the historical average speed for the road segment.

In another embodiment, the cost function is:

$$CF(t)=K(t)*Vh(t)*(|Vr(t)-Vh(t)|) \tag{2}$$

wherein a priority is placed on historically higher speed road segments (e.g., highways, etc.).

In yet another embodiment, the cost function is:

$$CF(t)=\frac{FF}{Vr(t)}*K(t)(|Vr(t)-Vh(t)|) \tag{3}$$

wherein the road segments are ranked based on a function of the free flow speed divided by the real-time average speed, thereby placing a priority on congested road segments.

In certain embodiments, based on the algorithm selected, a defined percentage of the ranked/prioritized traffic information may be transmitted as a traffic report aggregation of the entire network. The Ag(X) selection or granularity may determine what percentage of the traffic reports or which road segments/links are published or reported to consumers. For example, in certain embodiments, the top 1%, the top 5%, the top 10%, the top 25%, the top 50% of the priority queue may be encoded in a file (e.g., a Transport Protocol Experts Group (TPEG) file or TPEG-ML file) for reporting to a customer/client.

Naïve algorithms may provide a set or prioritization of non-contiguous links/road-segments in a network. While this may suffice for certain customers or traffic-consumers, it may not suffice for other customers who would prefer an area aggregation that elicits the important/critical links such that the links or road segments are contiguous (e.g., a minimum spanning tree algorithm, discussed below).

Minimum Spanning Tree Aggregation Algorithms

In certain embodiments, the algorithm used to calculate and prioritize the real-time traffic information is a minimum spanning tree algorithm. A minimum spanning tree (MST) algorithm may connect several vertices or road segments together, allowing for an analysis and prioritization of multiple, connected road segments. A specific weight may be assigned to each individual road segment within the connected series of road segments of the spanning tree. The minimum spanning tree may be calculated as a specific spanning tree with a weight less than or equal to the weight of every other spanning tree in the analyzed section of the city or metropolitan area. In other words, the spanning tree may connect several nodes in a section of a network/area/city such that the total sum of its arc/edge/link weight is minimized.

One advantage of using a MST algorithm is that it the algorithm may prioritize connectivity over cost, as road segments with less surprises may be reported as long as they are part of the network geometry that connects the road-segments with higher surprises, thereby producing a traffic information report that is representative of a typical route or network geometry that spans an area of a region of a city or an entire city.

In one embodiment, the minimum spanning tree algorithm is a cost function algorithm (e.g., an Edmonds' minimum spanning tree algorithm):

$$\frac{1}{CF(t)} = \frac{1}{K(t) * (|Vr(t) - Vh(t)|)} \tag{4}$$

Running Edmond's MST algorithm in real-time using this cost function may elicit a minimum spanning tree or a set of minimum spanning forest (several MSTs) having different root-nodes centered in critical regions of a transportation network. The MST(s) may include connected road links/segments that have higher traffic flow within that time period (i.e., more vehicles transverse them) and contain more surprises than other parts of the network.

In another embodiment, the minimum spanning tree algorithm may be a weighted cost function algorithm, wherein the traffic service provider or customer has the ability to weight a particular cost metric over another cost metric, depending on the application. For example, a weighted cost function algorithm may be achieved with weight metrics w1 and w2, wherein w1+w2=1, 0<w<1, and 0<w2<1. The modified algorithm is shown below:

$$\frac{1}{CF(t)} = \frac{w1}{K(t)} + \frac{w2}{(|Vr(t) - Vh(t)|)} \tag{5}$$

In certain embodiments, the values of w1 and w2 may be adjusted in favor of ranking road segments that carry the most traffic (K(t)) over traffic surprises (S=|Vr(t)−Vh(t)|). In other embodiments, the values of w1 and w2 may be adjusted in favor of ranking traffic surprises over road segments that carry the most traffic.

In certain embodiments, the traffic information on the set of spanning trees output from the algorithm may be transmitted as a traffic report aggregation of the entire network. The Ag(X) granularity may determine what percentage of the spanning trees are aggregated and published to consumers and which segments/links in a spanning tree are reported. The ranking of links in a spanning tree of weighted and directed network may be achieved by starting from the link connected to a root-node of the spanning tree and extending to a leaf node of the spanning tree. In certain embodiments, the top 1%, the top 5%, the top 10%, the top 25%, the top 50% of the prioritized links may be encoded in a file (e.g., a TPEG-ML file) for reporting to a customer/client.

Figure 1B:
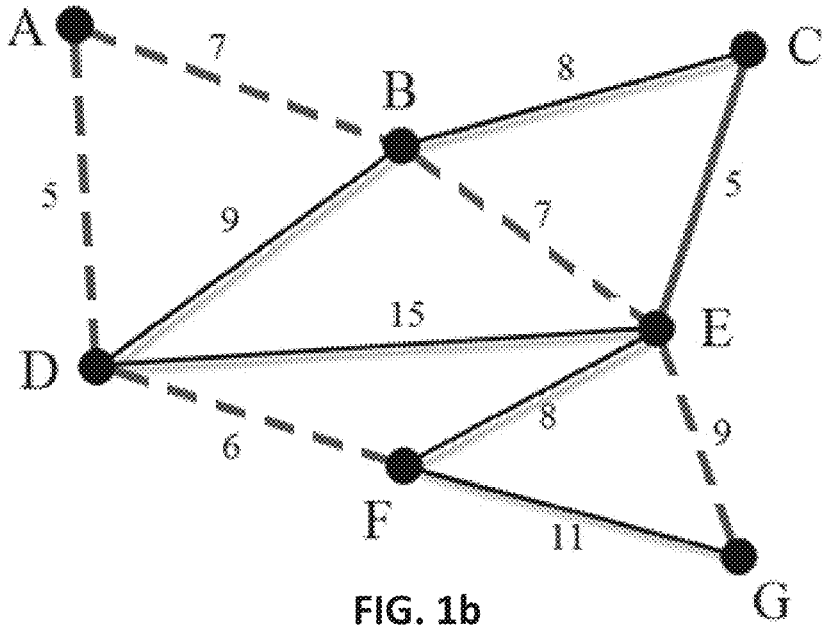

FIG. 1*a* depicts a sample network and FIG. 1*b* depicts a corresponding minimum spanning tree within the network in dashed lines. In FIG. 1*b*, the minimum spanning tree depicts a connected set of arcs/links that may form the set of contiguous links/road-segments to be reported as the aggregated traffic information for the network.

Requesting and Reporting Traffic Data

As mentioned above, a customer may request a specified percentage of the overall real-time traffic data collected by the traffic provider (e.g., based on a minimum spanning tree analysis of the real-time traffic data). The customer's choice may be tied to different costs or price points associated with the different percentages or aggregation classifications. Additionally, the customer's choice for receiving traffic data may be based on the customer's location within the network/area/city. In some embodiments, the customer may specifically request a certain area of the city be prioritized over other areas (e.g., based on their daily commute). In other embodiments, the customer may select a certain area of the city be prioritized over other areas based on their present location (e.g., the customer's navigation device may provide a GPS signal reporting their location and traffic data may be prioritized based on that location).

The customer's choice may also be tied to the overall file size of traffic data that may be reported for a network/area/city. For example, a customer may be working with a traffic device having a limited bandwidth that may only receive a certain amount of real-time traffic data in a given time frame. The customer may therefore choose to receive only a specific percentage of data (e.g., 1%, 5%, or 10% of the overall traffic data within the city) based upon the customer's limited bandwidth.

The customer may also choose to receive traffic data prioritized under a naïve algorithm, wherein the traffic data prioritizes unconnected or individual road segments. In other embodiments, the customer may choose to receive traffic data prioritized under a minimum spanning tree algorithm, wherein the traffic data may prioritize connected or combined road segments.

Based on the customer's request and selected level of traffic reporting, the traffic provider may process the real-time traffic data as described above, and bundle the requested aggregated traffic results for the customer in a data file for transmission. In certain embodiments, the (minimum spanning tree) traffic data is encoded in a TPEG-ML file for reporting/publishing. In certain embodiments, the TPEG- ML file is less than 1 megabyte (MB), less than 2 MB, less than 5 MB, less than 10 MB, less than 20 MB, or less than 50 MB in size.

In other embodiments, the traffic service provider may report a text-only list of the highest priority road names or road segments within the city or region/area of the city to the customer. In some embodiments, the report may comprise no more than a defined number of road names or road segments (e.g., 1, 2, 3, 5, or 10 road names/segments) to the customer. Such a report may capture the most important traffic situations within the area at a particular time. In some embodiments, the text-only report of the aggregated traffic results may be delivered to the customer in the form of a short message service (SMS) or a text messaging service (TMS).

Figure 2:
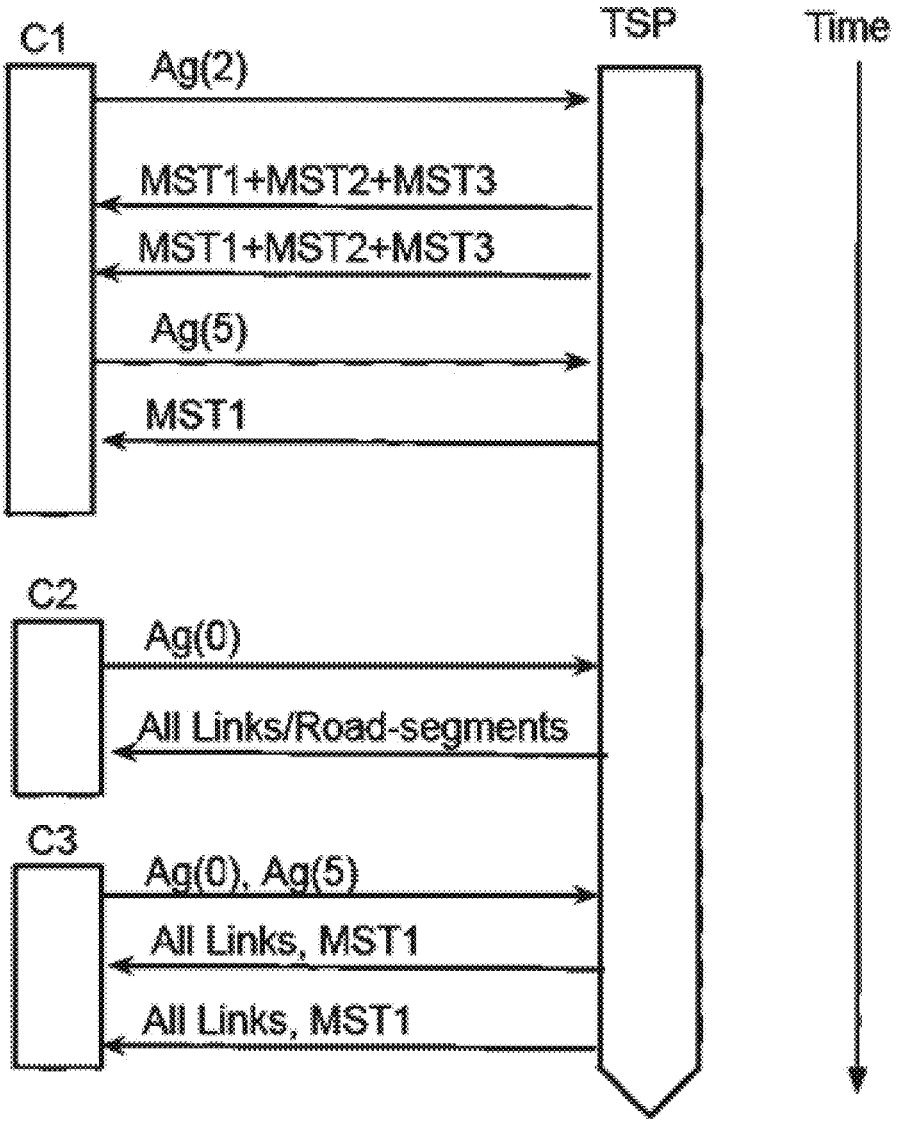
FIG. 2 illustrates an example of a traffic reporting system based on consumer aggregation requests.

FIG. 2 depicts one embodiment of the interaction between customers (C1, C2, C3) and a traffic service provider (TSP). In FIG. 2, one customer (C1) has requested one aggregation level of data (Ag(2)). Based on this selection, the TSP publishes and reports a certain percentage of real-time traffic to C1 in the form of minimum spanning trees (MST1, MST2, MST3). In this embodiment, the spanning trees are computed in real-time on the network based on changing values of Vr (real-time average speed). Over time, the TSP continues to update the real-time traffic data to the C1, republishing updated MST1, MST2, and MST3 to C1. At some point in time, C1 requests a smaller percentage of aggregated traffic data to be reported (e.g., Ag(5)). Based on this updated request, the TSP publishes and reports only MST1 to C1.

In FIG. 2, a second customer (C2) has requested no aggregation of real-time traffic data (i.e., Ag(0)). Based on this selection, the TSP publishes and reports all of the real-time traffic data links/road segments.

Finally, a third customer (C3) has made two requests—one for no aggregated traffic data (Ag(0)), and a second for a minimal amount of traffic data (Ag(5)). Based on these two requests, the TSP provides two publications/reports to C3. One report contains all of the real-time traffic data links/road segments. The second report contains prioritized traffic data included in a single minimum spanning tree (MST1).

Figure 3:
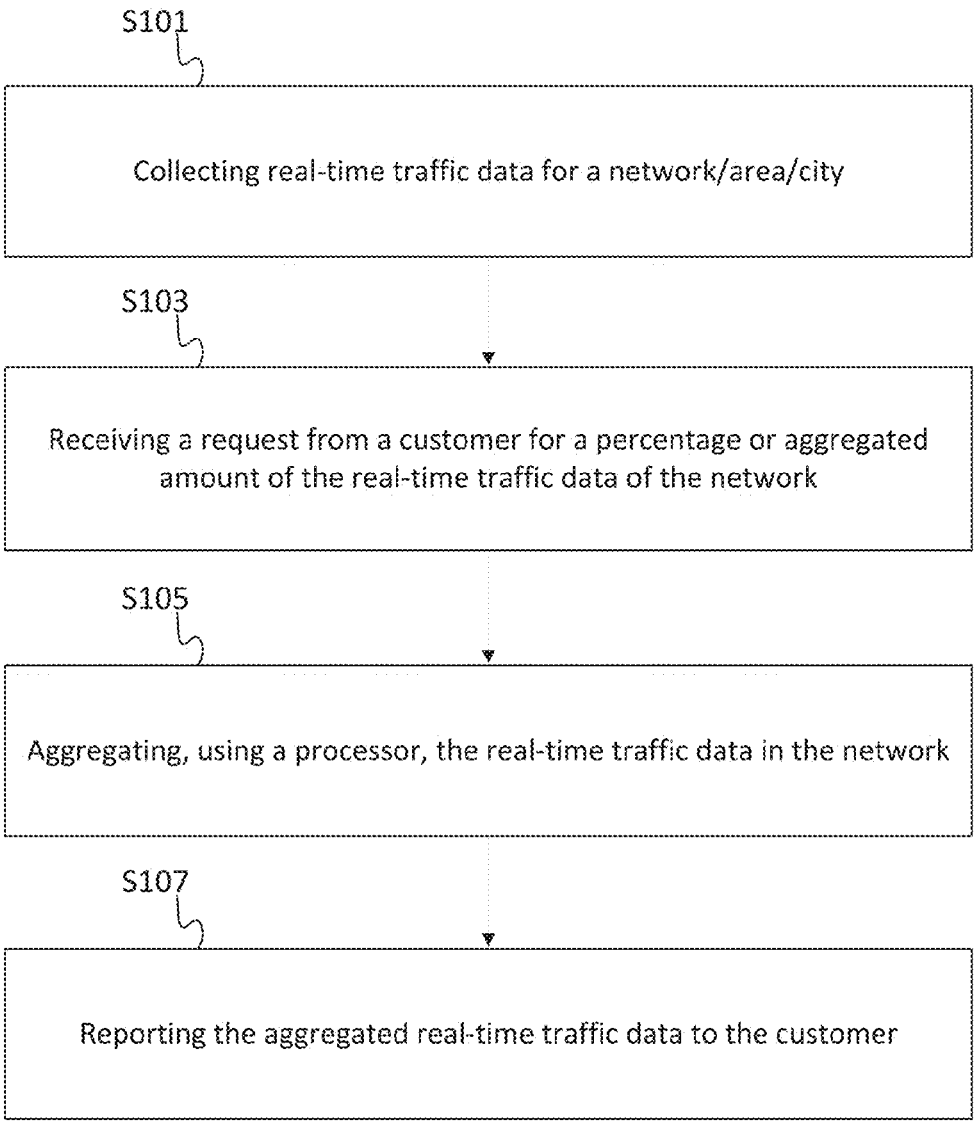
FIG. 3 illustrates an example flowchart for aggregating and reporting real-time traffic reports to a consumer.

FIG. 3 illustrates an example flowchart for aggregating and reporting real-time traffic conditions. The process of the flowchart may be performed by the device 122 and controller 200 and/or server 125 and processor 300, which may be referred to alternatively as the controller in the following description. Alternatively, another device may be configured to perform one or more of the following acts. Additional, fewer, or different acts may be included.

At act S101, real-time traffic data is collected for a network, area, or city. At act S103, the controller receives a request from a customer for a percentage (or aggregated amount) of the real-time traffic data of the network, area, or city. For example, as described above, the customer may request an aggregated amount of data that represents approximately 50% of the links/road segments in the overall network. In other embodiments, the customer may request an aggregated amount of data that represents approximately 40%, 30%, 25%, 20%, 10%, 5%, or 1% of the links/road segments in the overall network.

At act S105, the controller aggregates the real-time traffic data in the network, area, or city. The aggregation may be conducted using a naïve algorithm or a minimum spanning tree algorithm, as described in greater detail above.

At act S107, the controller reports the aggregated real-time traffic data to the customer based on their requested level of data.

Navigation Systems

Figure 4:
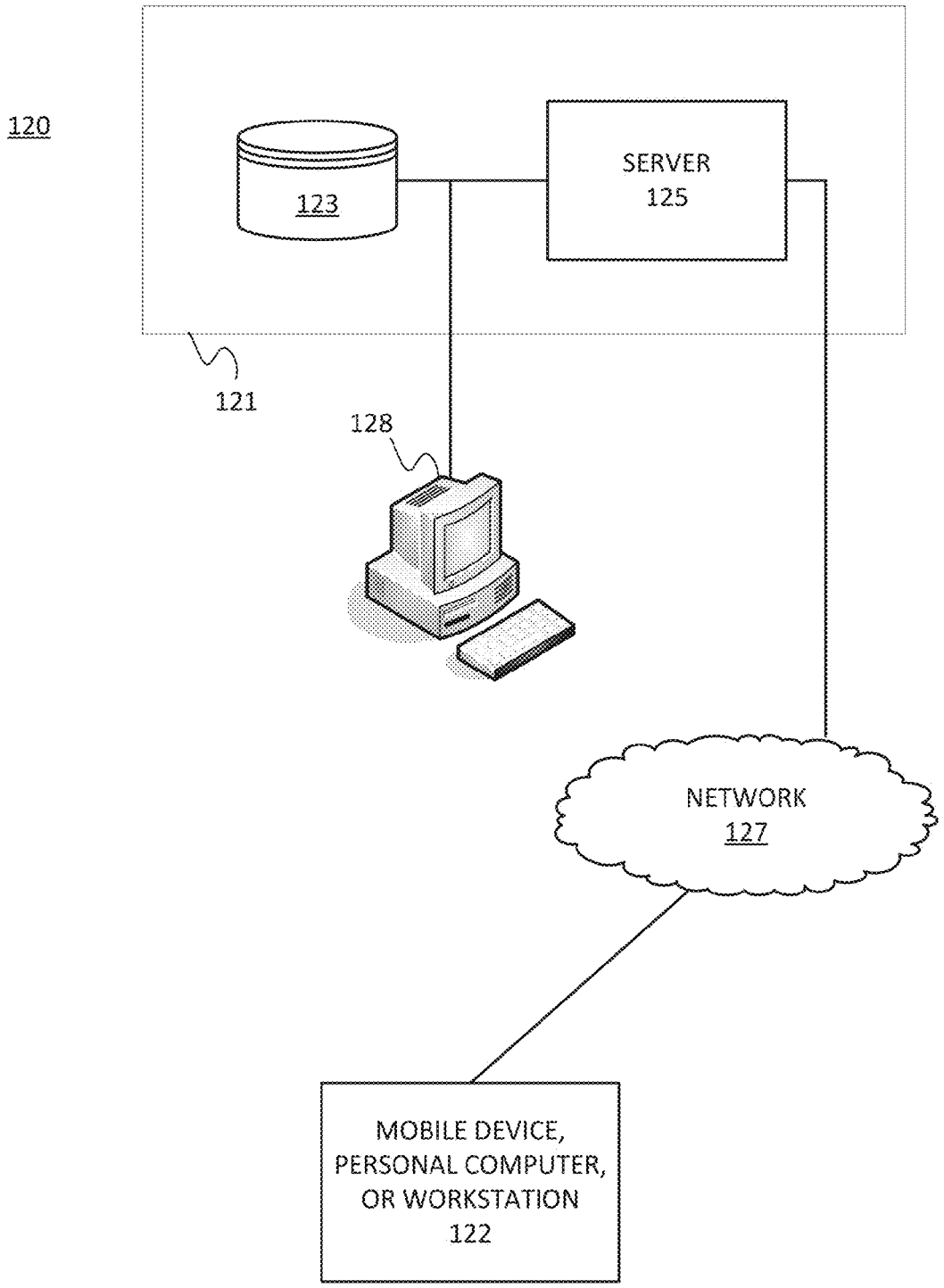
FIG. 4 illustrates an example system for requesting and/or receiving real-time traffic reports.

FIG. 4 illustrates an exemplary navigation system 120 for storing historical traffic data and requesting and reporting real-time traffic data. The navigation system 120 includes a map developer system 121, a mobile device, personal computer, or workstation 122, a workstation 128, and a network 127. Additional, different, or fewer components may be provided.

The device 122 may be a smart phone, a mobile phone, a personal digital assistant ("PDA"), a tablet computer, a notebook computer, a personal navigation device ("PND"), a portable navigation device, and/or any other known or later developed mobile device. In certain embodiments, the device 122 is transported in or on a vehicle (e.g., car, truck, motorcycle, bicycle, bus) or on a traveler. In certain embodiments, the mobile device 122 generates a message that provides the device's geographic location and sends the message to the server 125.

The developer system 121 includes a server 125 and a database 123. The developer system 121 may include computer systems and networks of a system operator such as HERE, NAVTEQ, or Nokia Corporation. The server database 123 is configured to store historical traffic data and/or real-time traffic data.

The developer system 121, the workstation 128, and the device 122 are coupled with the network 127. The phrase "coupled with" is defined to mean directly connected to or indirectly connected through one or more intermediate components. Such intermediate components may include hardware and/or software-based components.

The optional workstation 128 may be a general purpose computer including programming specialized for providing input to the server 125. For example, the workstation 128 may provide settings for the server 125. The settings may include a value for the predetermined interval that the server 125 requests the device 122 to relay current geographic locations. The workstation 128 may be used to enter data indicative of GPS accuracy to the database 123. The workstation 128 may include at least a memory, a processor, and a communication interface.

Figure 5:
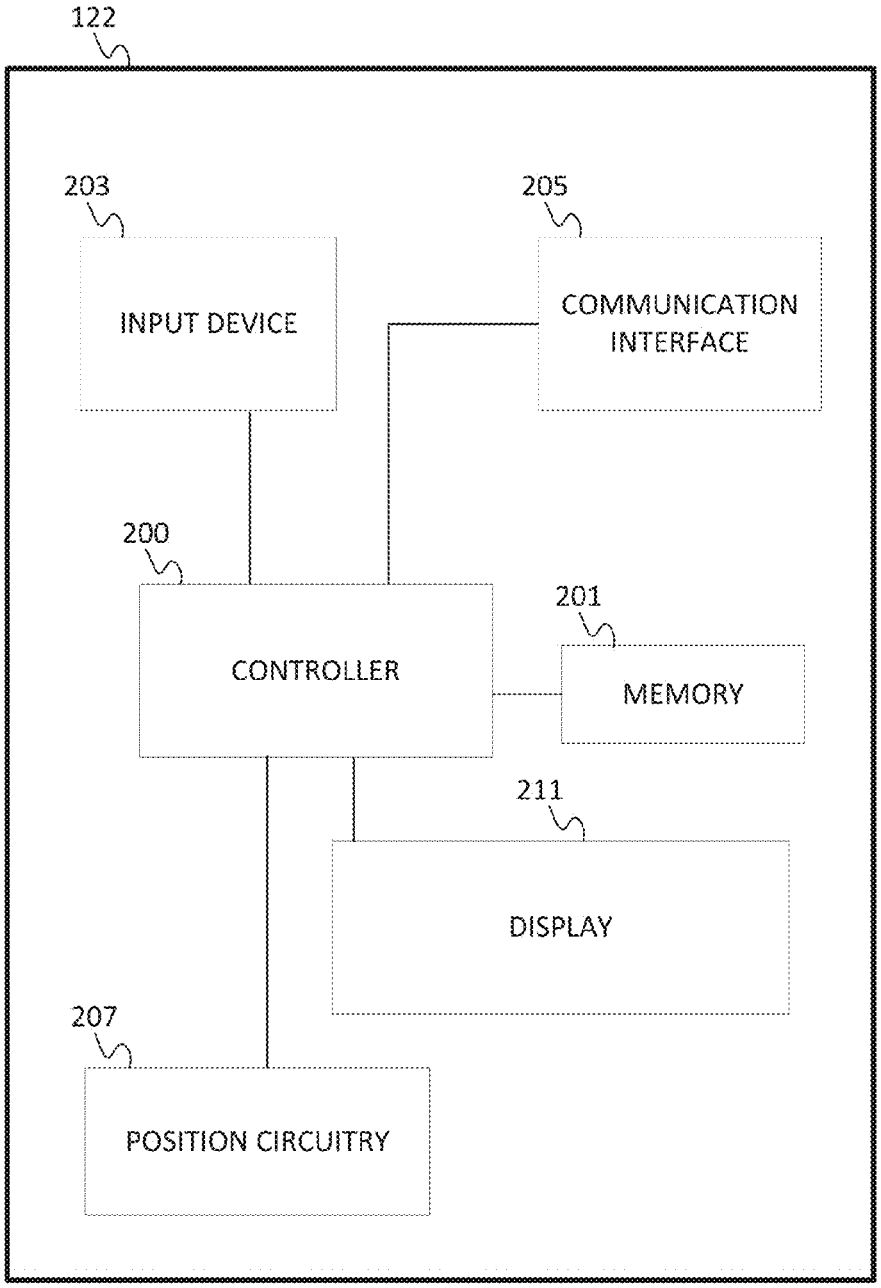
FIG. 5 illustrates an exemplary mobile device, personal computer, or workstation of the system of FIG. 4.

FIG. 5 illustrates an exemplary mobile device, personal computer, or workstation 122 of the real-time navigation system of FIG. 4. The device 122 may be referred to as a navigation device. The device 122 includes a controller 200, a memory 204, an input device 203, a communication interface 205, position circuitry 207, and a display 211. Additional, different, or fewer components are possible for the device 122.

The controller 200 is configured to receive data indicative of the location of the device 122 from the position circuitry 207. The positioning circuitry 207, which is an example of a positioning system, is configured to determine a geographic position of the device 122. The positioning circuitry 207 may include sensing devices that measure the traveling distance, speed, direction, and so on, of the device 122. The positioning system may also include a receiver and correlation chip to obtain a GPS signal. The positioning circuitry may include an identifier of a model of the positioning circuitry 207. The controller 200 may access the identifier and query a database or a website to retrieve the accuracy of the positioning circuitry 207 based on the identifier. The positioning circuitry 207 may include a memory or setting indicative of the accuracy of the positioning circuitry.

The positioning circuitry 207 may include a Global Positioning System (GPS), Global Navigation Satellite System (GLONASS), or a cellular or similar position sensor for providing location data. The positioning system may utilize GPS-type technology, a dead reckoning-type system, cellular location, or combinations of these or other systems. The positioning circuitry 207 may include suitable sensing devices that measure the traveling distance, speed, direction, and so on, of the device 122. The positioning system may also include a receiver and correlation chip to obtain a GPS signal. The device 122 receives location data from the positioning system. The location data indicates the location of the device 122.

Figure 6:
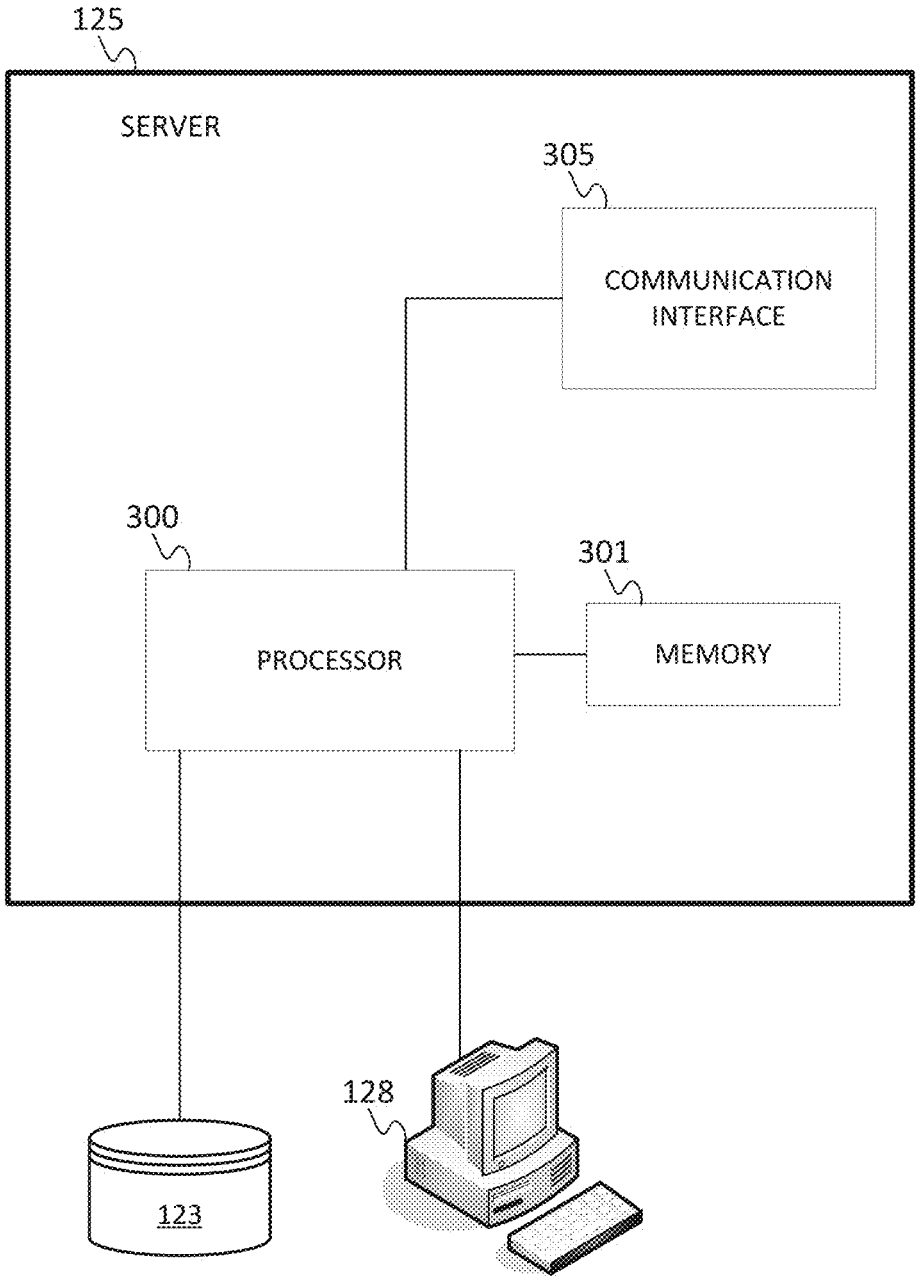
FIG. 6 illustrates an exemplary server of the system of FIG. 4.

FIG. 6 illustrates an exemplary server 125 of the navigation system of FIG. 4. The server 125 includes a processor 300, a communication interface 305, and a memory 301. The server 125 may be coupled to a database 123 and a workstation 128. The database 123 may be a geographic database as discussed above. The workstation 128 may be used as an input device for the server 125. In addition, the communication interface 305 is an input device for the server 125. The communication interface 305 receives data indicative of use inputs made via the workstation 128 or the mobile device 122.

The controller 200 and/or processor 300 may include a general processor, digital signal processor, an application specific integrated circuit (ASIC), field programmable gate array (FPGA), analog circuit, digital circuit, combinations thereof, or other now known or later developed processor. The controller 200 and/or processor 300 may be a single device or combinations of devices, such as associated with a network, distributed processing, or cloud computing.

The controller 200 and/or the processor 300 may also be configured to cause an apparatus to at least perform at least one of traffic map image retrieval methods described above. For example, the controller or processor may be configured to perform the process: (1) collect real-time traffic data for a network; (2) receive a request from a customer for a percentage of the real-time traffic data in the network, the percentage being greater than 0% and less than 100%; (3) aggregate, using a processor, the real-time traffic data in the network; and (4) report the aggregated real-time traffic data to the customer.

The memory 204 and/or memory 301 may be a volatile memory or a non-volatile memory. The memory 204 and/or memory 301 may include one or more of a read only memory (ROM), random access memory (RAM), a flash memory, an electronic erasable program read only memory (EEPROM), or other type of memory. The memory 204 and/or memory 301 may be removable from the device 122, such as a secure digital (SD) memory card.

The communication interface 205 and/or communication interface 305 may include any operable connection. An operable connection may be one in which signals, physical communications, and/or logical communications may be sent and/or received. An operable connection may include a physical interface, an electrical interface, and/or a data interface. The communication interface 205 and/or communication interface 305 provides for wireless and/or wired communications in any now known or later developed format.

In the above described embodiments, the network 127 may include wired networks, wireless networks, or combinations thereof. The wireless network may be a cellular telephone network, an 802.11, 802.16, 802.20, or WiMax network. Further, the network 127 may be a public network, such as the Internet, a private network, such as an intranet, or combinations thereof, and may utilize a variety of networking protocols now available or later developed including, but not limited to TCP/IP based networking protocols.

While the non-transitory computer-readable medium is described to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Although the present specification describes components and functions that may be implemented in particular embodiments with reference to particular standards and protocols, the invention is not limited to such standards and protocols. For example, standards for Internet and other packet switched network transmission (e.g., TCP/IP, UDP/IP, HTML, HTTP, HTTPS) represent examples of the state of the art. Such standards are periodically superseded by faster or more efficient equivalents having essentially the same functions. Accordingly, replacement standards and protocols having the same or similar functions as those disclosed herein are considered equivalents thereof.

A computer program (also known as a program, software, software application, script, or code) can be written in any form of programming language, including compiled or interpreted languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

As used in this application, the term "circuitry" or "circuit" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Processors suitable for the execution of a computer program include, by way of example, both general and special purpose microprocessors, and anyone or more processors of any kind of digital computer. Generally, a processor receives instructions and data from a read only memory or a random access memory or both. The essential elements of a computer are a processor for performing instructions and one or more memory devices for storing instructions and data. Generally, a computer also includes, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., E PROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments of the subject matter described in this specification can be implemented on a device having a display, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Embodiments of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings and described herein in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, are apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. A method comprising:

collecting real-time traffic data for a network from one or more probes;

receiving a request from a navigation device for a first percentage of the real-time traffic data in the network;

identifying, using a processor, a cost function for each of a plurality of road segments;

ranking, using the processor, each of the plurality of road segments based on the cost function;

aggregating, using the processor, the first percentage of data including road segments having a rank above the first percentage of the total plurality of road segments in the network; and transmitting the aggregated first percentage of data to the navigation device.

2. The method of claim 1, wherein identifying the cost function for each of the plurality of road segments is based on a naïve algorithm.

3. The method of claim 2, wherein the naïve algorithm determines the cost function for each road segment of the plurality of road segments by multiplying a traffic density by a difference of a real-time average speed and a historic average speed, and wherein the priority is based on the cost functions for the plurality of road segments.

4. The method of claim 2, wherein the naïve algorithm determines the cost function for each road segment of the plurality of road segments by multiplying a traffic density by a historic average speed by a difference of a real-time average speed and the historic average speed, and wherein the priority is based on the cost functions for the plurality of road segments.

5. The method of claim 1, wherein identifying the first percentage comprises prioritizing the real-time traffic data for a plurality of connected road segments based on a minimum spanning tree algorithm.

6. The method of claim 5, wherein the minimum spanning tree algorithm determines the cost function for each road segment of the plurality of connected road segments, wherein:

$$\frac{1}{CF(t)} = \frac{1}{K(t) * (|Vr(t) - Vh(t)|)}$$

where:

CF(t)=the cost function for a road segment;

K(t)=a number of vehicles occupying the road segment within a given time frame;

Vr(t)=a real-time average speed for the number of vehicles within the road segment at the given time frame; and Vh(t)=a historical average speed for the road segment at a comparable time frame.

7. The method of claim 5, wherein the minimum spanning tree algorithm determines the cost function for each road segment of the plurality of connected road segments, wherein:

$$\frac{1}{CF(t)} = \frac{w1}{K(t)} + \frac{w2}{(|Vr(t) - Vh(t)|)}$$

where:

CF(t)=the cost function for a road segment;

K(t)=a number of vehicles occupying the road segment within a given time frame;

Vr(t)=a real-time average speed for the number of vehicles within the road segment at the given time frame;

Vh(t)=a historical average speed for the road segment at a comparable time frame;

$0<w1<1$;

$0<w2<1$; and $w1+w2=1$.

8. The method of claim 7, wherein $w1>w2$.

9. The method of claim 7, wherein $w2>w1$.

10. The method of claim 1, wherein the reporting comprises encoding the aggregated real-time traffic data in a TPEG-ML file.

11. The method of claim 1, wherein the first percentage of data is less than 10% of the real-time traffic data.

12. The method of claim 1, further comprising:

aggregating, using the processor, a second subset of data including road segments having a rank above a second percentage of the total plurality of the road segments in the network; and transmitting the second subset of data to the navigation device when requested by the device.

13. A method comprising:

collecting, from one or more probes, real-time traffic data for a plurality of road segments in a network;

identifying, using a processor, a number of vehicles occupying each road segment of the plurality of road segments within a given time frame;

calculating, using the processor, an average speed for each road segment at the given time frame;

identifying, using the processor, a historical speed for the road segment at a comparable time frame;

calculating, using the processor, a cost function based on the number of vehicles and a difference between the average speed and historical speed for each road segment;

receiving a request from a navigation device for a first percentage of the real-time traffic data in the network;

ranking, using the processer, each road segment of the plurality of road segments based on the cost function;

aggregating, using the processor, the first percentage of the real-time traffic data in the network based on the ranking; and reporting the first percentage of aggregated real-time traffic data to the navigation device in a transport protocol experts group (TPEG-ML) file.

14. The method of claim 13, further comprising:

aggregating, using the processor, a second subset of data by prioritizing the real-time traffic data for a plurality of road segments based on the cost function; and transmitting the second subset of data to the navigation device when requested by the device.

15. An apparatus comprising:

at least one processor; and at least one memory including computer program code for one or more programs; the at least one memory and the computer program code configured to, with the at least one processor, cause the apparatus to at least perform:

collect, from one or more probes, real-time traffic data for a plurality of road segments in a network;

identify a number of vehicles occupying each road segment of the plurality of road segments within a given time frame;

calculate an average speed for each road segment from the real-time traffic data at the given time frame;

identify a historical speed for the road segment at a comparable time frame from historical traffic data stored in the at least one memory;

calculate a cost function based on the number of vehicles and a difference between the average speed and historical speed for each road segment;

receive a request from a navigation device for a first percentage of the real-time traffic data in the network, rank each road segment of the plurality of road segments based on the cost function;

aggregate the first percentage of the real-time traffic data in the network based on the rank; and report the aggregated real-time traffic data to the navigation device.

16. The apparatus of claim 15, wherein calculating the cost function is based on a minimum spanning tree algorithm, wherein the minimum spanning tree algorithm determines the cost function for each road segment of the plurality of connected road segments, wherein:

$$\frac{1}{CF(t)} = \frac{1}{K(t) * (|Vr(t) - Vh(t)|)}$$

where:

CF(t)=the cost function for a road segment;

K(t)=the number of vehicles occupying the road segment within a given time frame;

Vr(t)=the real-time average speed for the number of vehicles within the road segment at the given time frame; and Vh(t)=the historical average speed for the road segment at a comparable time frame.

17. The apparatus of claim 15, wherein calculating the cost function is based on a minimum spanning tree algorithm, wherein the minimum spanning tree algorithm determines the cost function for each road segment of the plurality of connected road segments, wherein:

$$\frac{1}{CF(t)} = \frac{w1}{K(t)} + \frac{w2}{(|Vr(t) - Vh(t)|)}$$

where:

CF(t)=the cost function for a road segment;

K(t)=the number of vehicles occupying the road segment within a given time frame;

Vr(t)=the real-time average speed for the number of vehicles within the road segment at the given time frame;

Vh(t)=the historical average speed for the road segment at a comparable time frame;

$0<w1<1$;

$0<w2<1$; and $w1+w2=1$.

18. The apparatus of claim 17, wherein $w1>w2$.

19. The apparatus of claim 17, wherein $w2>w1$.

20. The apparatus of claim 15, wherein the reporting comprises encoding the aggregated real-time traffic data in a TPEG-ML file.

21. The apparatus of claim 15, wherein the first percentage of real-time traffic data comprises less than 10% of the real-time traffic data.

* * * * *